United States Patent [19]

Sayles

[11] Patent Number: 4,655,858

[45] Date of Patent: Apr. 7, 1987

[54] BURNING RATE ENHANCEMENT OF SOLID PROPELLANTS BY MEANS OF METAL/OXIDANT AGGLOMERATES

[75] Inventor: David C. Sayles, Huntsville, Ala.

[73] Assignee: The United States of America as represented by the Secretary of the Army, Washington, D.C.

[21] Appl. No.: 31,110

[22] Filed: Apr. 17, 1979

[51] Int. Cl.[4] ..... C06B 45/10

[52] U.S. Cl. ..... 149/19.92; 149/19.2; 149/19.4; 149/19.9; 149/20

[58] Field of Search ..... 149/19.2, 19.4, 19.9, 149/19.92, 20

[56] References Cited

U.S. PATENT DOCUMENTS

| | | | |
|---|---|---|---|
| 3,761,330 | 9/1973 | Lou et al. | 149/19.2 |
| 3,793,099 | 2/1974 | Duerksen et al. | 149/19.4 |
| 3,809,585 | 5/1974 | Greenberg | 149/19.4 |
| 3,892,610 | 7/1975 | Huzinec | 149/19.92 |
| 3,932,240 | 1/1976 | Braun et al. | 149/19.2 |
| 3,954,526 | 5/1976 | Mangum et al. | 149/19.9 |
| 3,986,909 | 10/1976 | Macri | 149/19.9 |
| 4,092,189 | 5/1978 | Betts | 149/19.2 |
| 4,110,135 | 8/1978 | Graham et al. | 149/19.9 |
| 4,133,706 | 1/1979 | Shoults | 149/19.9 |
| 4,462,848 | 7/1984 | Elrick | 149/19.92 |

*Primary Examiner*—Edward A. Miller
*Attorney, Agent, or Firm*—William G. Gapcynski; Werten F. W. Bellamy; Jack W. Voigt

[57] ABSTRACT

Preformed metal/oxidant agglomerates for enhancement of propellant burning rate are prepared from a finely divided metal (aluminum, boron, titanium, etc.), ammonium perchlorate, and a small quantity of the same binder material that goes into the manufacture of the propellant, such as, hydroxyl-terminated polybutadiene crosslinked with a polyisocyanate. Additional ingredients can be incorporated into the agglomerates to bring about further enhancement of burning rate, such as, an ammonium perchlorate decomposition accelerator triphenylbismuthine, a carboranyl burning rate enhancer, iron oxide, etc. Agglomerates are prepared in a fluorinated and/or chlorinated hydrocarbon solvent in which the agglomerate formulation ingredients are insoluble. Any remaining solvent is then evaporated under reduced pressure and the agglomerates are subsequently cured. Optimum mesh size of the agglomerates is 300–500 micrometers. These agglomerates cause a major increase in the burning rate of solid propellants when incorporated therein in percentages of 1–5%.

4 Claims, No Drawings

BURNING RATE ENHANCEMENT OF SOLID PROPELLANTS BY MEANS OF METAL/OXIDANT AGGLOMERATES

DEDICATORY CLAUSE

The invention described herein may be manufactured, used, and licensed by or for the Government for governmental purposes without the payment to me of any royalities thereon.

BACKGROUND OF THE INVENTION

Metal has been used to enhance the burning rate of solid propellant compositions. The metal has been added to uncured solid propellant compositions in various forms, e.g., ribbons, powder, staples, spheroidal, and other geometric shapes.

More recently, U.S. Pat. No. 4,092,189 issued to Robert E. Betts on May 30, 1978 and assigned to the United States of America as represented by the Secretary of the Army, Washington, D.C., is directed to a method of preparing high burning rate solid propellant grains that have good mechanical properties. This patent covers a high burning rate solid propellant grain prepared from a multimodal blend of at least one ultra-high burning rate propellant that has been cured and ground to a predetermined particle size of from about 100 microns (0.1 millimeter) to about 5 millimeters and at least one uncured propellant composition that has high tensile strength and compatibility with the ultra-high burning rate propellant and that serves as a binder for the solid propellant grain when cured.

The method of U.S. Pat. No. 4,092,189 includes preparing a cured ultra-high burning rate propellant that is subsequently ground and screened to a predetermined particle size. The ground and screened propellant is then combined with uncured propellant that is subsequently cured to yield a high burning rate solid propellant grain with good mechanical properties.

An improvement to the burning rate technology provided by an improved process in producing the enhancer for propellant burning rate and the technique of using the enhancer for propellant burning rate would be welcomed additions to the propulsion industry art.

Therefore, it is an object of this invention to provide a means for effecting a major increase in the burning rate of solid propellants.

Another object of this invention is to provide burning rate enhancement of solid propellants by means of metal/oxidant agglomerates.

A further object of this invention is to provide metal-/oxidant agglomerates which are prepared by an improved method wherein the agglomerates formulation is slurred in a fluorinated and/or chlorinated hydrocarbon solvent at ambient temperature to form agglomerates in mixture, followed by maintaining the mixture at 135 degrees Fahrenheit with stirring, and with continued stirring while the mixture is maintained under reduced pressure to remove any residual solvent. Subsequent curing of the agglomerates is accomplished at 150–170 degrees Fahrenheit for about 24 hours.

SUMMARY OF THE INVENTION

The metal/oxidant agglomerates of this invention which provide a means of burning rate enhancement of solid propellants are produced from a finely divided metal selected from aluminum, boron, and titanium, ammonium perchlorate, and a small quantity of the same binder material that goes into the manufacture of the propellant, such as, hydroxyl-terminated polybutadiene crosslinked with a polyisocyanate. Additional ingredients can be incorporated into the metal/oxidant agglomerates to bring about further enhancement of burning rate. These additional ingredients can include one or more ingredients selected from an ammonium perchlorate decomposition accelerator (0.2–0.5 weight percent) (e.g., triphenylbismuthine), a carboranyl burning rate enhancer (0.5–2.0 weight percent) (e.g., n-hexylcarborane), iron oxide (0.1–2.0 weight percent), etc. These additives can be used in varied ratio, e.g., triphenylbismuthine 0.5%, n-hexylcarborane 0.5%, and iron oxide 1.0% or the additive can be used alone in the agglomerate formulation.

The method of preparing the metal/oxidant agglomerates for use in this invention is summarized as follows: The various ingredients, consisting of the finely divided metal, ammonium perchlorate, hydroxyl-terminated polybutadiene, isophorone diisocyanate, the ammonium perchlorate decomposition accelerator, and a burning rate enhancer are slurried in Freon TF (trichlorotrifluoroethane) for 15 minutes at ambient temperature to form agglomerates, followed by increasing temperature to about 135 degrees Fahrenheit and maintaining the mixture at 135 degrees Fahrenheit with stirring for final agglomerate formation, followed by maintaining under reduced pressure to remove any residual Freon, and then followed by curing the agglomerates at 150–170 degrees Fahrenheit for about 24 hours.

The agglomerates are screened to separate the agglomerates into different mesh sizes. The most effective mesh size is in the range of 300–500 micrometers. The agglomerates are incorporated into an uncured propellant formulation in percentages of the order of 1–5%. The higher the amount of agglomerate the higher will the burning rate enhancement be. A typical baseline propellant to which the agglomerates are incorporated contains a high solid loading of a blend of fine and ultrafine ammonium perchlorate, aluminum metal fuel, hydroxyl-terminated polybutadiene, diisocyanate crosslinking agent, and metal oxide burning rate catalyst. For higher catalytic performance a carboranyl burning rate catalyst can be employed. Additionally, a perchlorate decomposition accelerator, triphenylbismuthine can be used.

DESCRIPTION OF THE PREFERRED EMBODIMENT

Preformed agglomerates are prepared from a metal (aluminum, boron, titanium, etc.), ammonium perchlorate, and a small quantity of the same binder material that goes into the manufacture of the propellant, e.g., hydroxyl-terminated polybutadiene crosslinked with a polyisocyanate. Optimum mesh size of the agglomerates is 300–500 micrometers. The agglomerates cause a major increase in the burning rate of solid propellants when incorporated therein in the percentages of 1–5%.

A preferred procedure for preparing the agglomerates is as follows: The various ingredients, as set forth in Table I below: Composition of a Typical Agglomerate, are slurried in a fluorinated and/or chlorinated solvent (e.g., trichlorotrifluoroethane or trichloroethylene) for 15 minutes at ambient temperature. The slurried mixture is maintained at about 135 degrees Fahrenheit with stirring for final agglomerate formation. Finally, the stirring is continued under reduced pressure to remove any residual solvent. The agglomerates are then cured at 150–170 degrees Fahrenheit for 24 hours.

The type solvent selected for use in the formation of the agglomerates should be a solvent in which the agglomerate formulation ingredients are insoluble and one which can be readily removed under reduced pressure. In addition to Freon TF, other fluorinated and/or chlorinated hydrocarbon solvents, such as trichloroethylene, can be used in the method wherein agglomerates are formed in the slurried mixture. The formation technique will result in a range of particle sizes for the agglomerates formed; therefore, for more precise control of the end results, screening of particle size or sizes for optimum results can be made for a desired level of performance and burning rate enhancement.

TABLE 1

COMPOSITION OF A TYPICAL AGGLOMERATE

| INGREDIENT | WEIGHT PERCENT |
|---|---|
| AMMONIUM PERCHLORATE(1 micrometer weight-median-diameter) | 23. |
| AMMONIUM PERCHLORATE(3 micrometer weight-median-diameter) | 23. |
| ALUMINUM(spheroidal) (50 micrometer weight-median-diameter) | 48. |
| HYDROXYL-TERMINATED POLYBUTADIENE PREPOLYMER<br>ISOPHORONE DIISOCYANATE* | 4. |
| FERRIC OXIDE | 2. |

*An effective amount (e.g., 0.5–1.0 weight percent)added as a crosslinking agent.

The composition of a typical baseline propellant used in the evaluation of the effectiveness of agglomerates as a means of burning rate enhancement is presented in Table 2 below.

TABLE 2

COMPOSITION OF A TYPICAL BASELINE PROPELLANT

| INGREDIENT | WEIGHT PERCENT |
|---|---|
| AMMONIUM PERCHLORATE(Weight-Median Diameter = 1 Micrometer) | 34. |
| AMMONIUM PERCHLORATE(Weight-Median-Diameter = 3 Micrometers) | 34. |
| ALUMINUM(Spheroidal) (Weight-Median-Diameter = 50 Micrometers) | 16. |
| HYDROXYL-TERMINATED POLYBUTADIENE PREPOLYMER<br>ISOPHORONE DIISOCYANATE* | 14. |
| FERRIC OXIDE | 2. |

An effective amount (e.g., 0.5–1.0 Weight percent) added a a crosslinking agent.

| CHARACTERISTICS: | |
|---|---|
| Burning Rate(ips at 2000 psi) | 2.6 |
| Pressure Exponent | 0.66 |

The new concept of this invention has the potential of producing solid propellants which have burning rates in the 20–30 inches per second regime at 2000 psi operating pressure. Since this concept requires only the usual propellant ingredients, rather than undeveloped or expensive constituents, it represents a breakthrough in the development of ultrahigh burning rate, solid propellants. Using this approach, it should be possible to attain burning rates heretofore unattainable.

I claim:

1. A method for preparing a solid propellant with increased burning rate achieved by incorporating from about 1 to about 5 weight percent of metal/oxidant agglomerates into an uncured solid propellant formulation and curing the solid propellant formulation having said agglomerates intimately dispersed therein to form a solid propellant grain, said method comprising:

(i) providing metal/oxidant agglomerate formulation ingredients comprised of about 23 weight percent of ammonium perchlorate of about 1 micrometer weight-median-diameter, of about 23 weight percent of ammonium perchlorate of about 3 micrometer weight-median-diameter, of about 48 weight percent of a spheroidal shaped metal selected from the metals consisting of aluminum, boron, and titanium of about 50 micrometer weight-median-diameter, of about 4 percent of hydroxyl-terminated polybutadiene prepolymer which contains an effective amount of about 0.5–0.1 weight percent of isophorone diisocyanate as a crosslinking agent, and an amount of about 2 weight percent total additives selected from a carboranyl burning rate enhancer, triphenylbismuthine as an ammonium perchlorate decomposition accelerator, and iron oxide;

(ii) introducing an excess amount of a fluorinated and/or chlorinated hydrocarbon solvent into a container and then introducing said metal/oxidant agglomerate formulation ingredients into said solvent in which said metal/oxidant agglomerate formulation ingredients are insoluble, said container provided with stirring means to form a slurry and said container provided with pressure reducing means to permit operation under reduced pressure;

(iii) mixing said metal/oxidant agglomerate formulation ingredients to form a slurry and continue said mixing for about 15 minutes at ambient temperature to form agglomerates as said metal/oxidant agglomerate formulation ingredients are slurred in said fluorinated and/or chlorinated hydrocarbon solvent;

(iv) increasing the temperature of said slurry and said agglomerate formulation ingredients to about 135 degrees Fahrenheit to accomplish final agglomerate formation, subsequently removing said solvent, and then continuing said mixing within said container under reduced pressure to remove any residual of said solvent remaining after said final agglomerate formation;

(v) removing said metal/oxidant agglomerates from said container and then curing said metal/oxidant agglomerates at 150–170 degrees Fahrenheit for about 24 hours;

(vi) screening said cured metal/oxidant agglomerates into different mesh sizes from which a selection is made of a desired effective mesh size for adding to an uncured propellant formulation;

(vii) adding from about 1 to about 5 weight percent of said metal/oxidant agglomerates to an uncured propellant formulation, said uncured propellant formulation comprised of about 34 weight percent of ammonium perchlorate of about 1 micrometer weight-median-diameter, of about 34 weight percent of ammonium perchlorate of about 3 micrometer weight-median diameter, of about 16 weight percent of spheroidal aluminum of about 50 micrometer weight-median-diameter, of about 14 weight percent of hydroxyl-terminated polybutadiene prepolymer which contains an effective amount of about 0.5–1.0 weight percent isophorone diisocyanate as a crosslinking agent, and an amount of about 2 weight percent total additive selected from a carboranyl burning rate enhancer, triphenylbismuthine as an ammonium perchlorate decomposition accelerater, and iron oxide; and, (viii) curing said uncured propellant formulation having said agglomerates intimately dispersed therein to form a solid propellant grain.

2. The method of claim 1 wherein said cured metal/oxidant agglomerates added are in the range of about 300–500 micrometers.

3. The method of claim 2 wherein said additive selected for said metal/oxidant agglomerates formulation is iron oxide in an amount of about 2 weight percent and wherein said additive selected for said uncured propellant formulation is iron oxide in an amount of about 2 weight percent.

4. The method of claim 1 wherein said speroidal shaped metal selected for said metal/oxidant agglomerate formulation is aluminum and wherein said additives selected for said metal/oxidant agglomerate formulation are triphenylbismuthine in an amount of about 0.5 weight percent, n-hexylcarborane in an amount of about 0.5 weight percent, and iron oxide in an amount of about 1.0 weight percent.

* * * * *